United States Patent [19]

Rieckenberg

[11] 4,380,840

[45] Apr. 26, 1983

[54] BOTTLE CLEANING DEVICE

[76] Inventor: Ivan L. Rieckenberg, Rte. 1, Box 148E, Steeleville, Ill. 62288

[21] Appl. No.: 335,725

[22] Filed: Dec. 30, 1981

[51] Int. Cl.[3] ..... A47G 19/30

[52] U.S. Cl. ..... 15/105; 15/236 R; 15/245

[58] Field of Search ..... 15/245, 236 R, 105, 15/118, 121; D7/102

[56] References Cited

U.S. PATENT DOCUMENTS

| | | | |
|---|---|---|---|
| 2,036,549 | 4/1936 | Smith | 15/236 R X |
| 2,291,015 | 7/1942 | Anderson | 15/236 R X |
| 2,828,502 | 4/1958 | Tupper | 15/245 X |
| 4,355,432 | 10/1982 | Storm, Jr. | 15/245 |

*Primary Examiner*—Edward L. Roberts
*Attorney, Agent, or Firm*—Kinzer, Plyer, Dorn & McEachran

[57] ABSTRACT

A unitary molded plastic bottle cleaning device, particularly adapted to cleaning catsup bottles but also usable for jelly jars and other small bottles, comprises an elongated shaft having a thin, relatively flat primary scraper blade of generally triangular peripheral configuration mounted on and extending transversely of one end of the shaft at an angle of about 40°, the primary blade having a linear edge for scraping flat interior bottle surfaces and a rounded edge for scraping curved interior bottle surfaces and corners; a smaller transverse flat blade on the other end of the shaft is used to clean the neck of a bottle.

10 Claims, 4 Drawing Figures

Fig. 1.
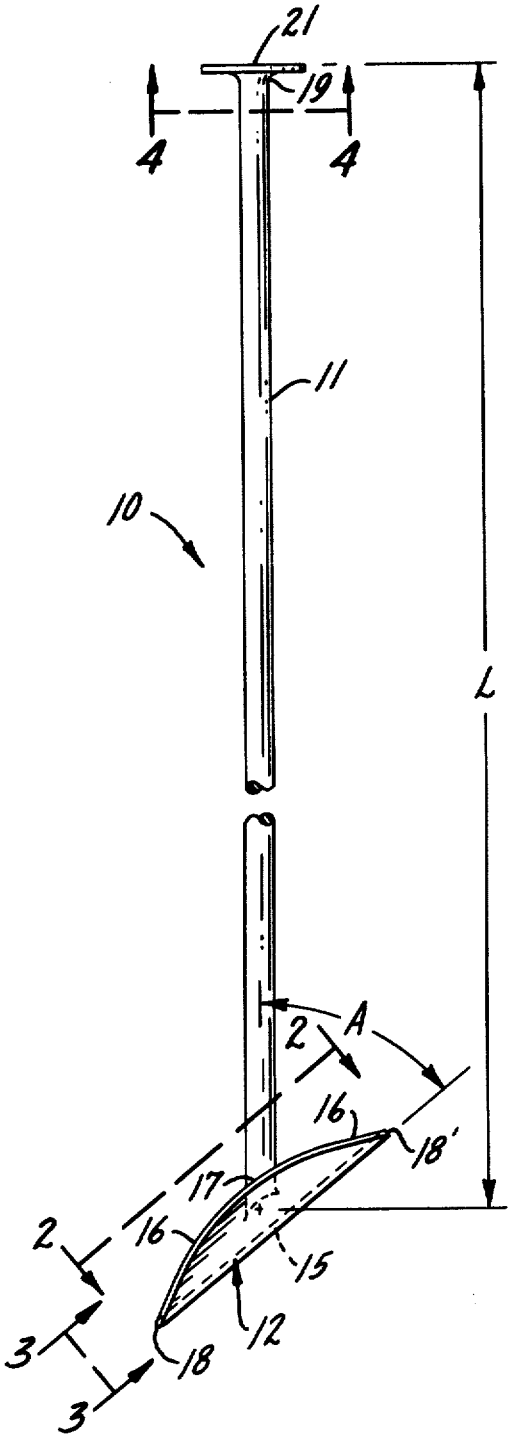
Fig. 2.
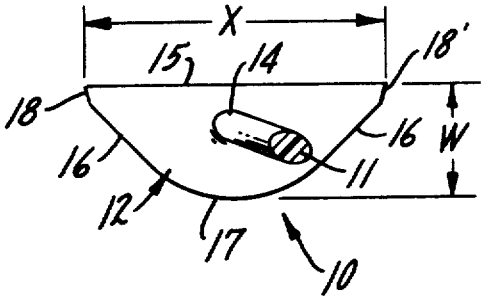
Fig. 3.
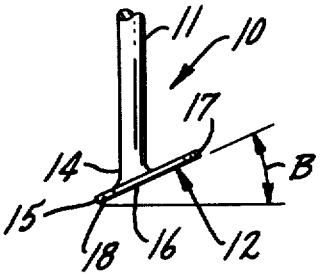
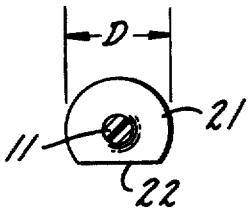
Fig. 4.

BOTTLE CLEANING DEVICE

BACKGROUND OF THE INVENTION

The cleanout of a small bottle containing relatively thick, viscous material, so as to obtain the benefit of all of the material contained in the bottle, frequently presents a difficult problem. The classic example is the conventional catsup bottle. A thick catsup tends to remain settled in the bottom of the bottle, sometimes despite rather violent attempts to dislodge it. The neck of the bottle often proves to be a bottleneck indeed, defying attempts to start the discharge of catsup from the bottle. The shape of the bottle sometimes contributes to the overall problem; a hexagonal or octagonal bottle, having flat interior surfaces and numerous corners, adds materially to the difficulties in attempting to get all of the catsup out of the bottle.

A number of different forms of bottle cleaning devices has previously been proposed. For the most part, these devices constitute rubber or plastic spatulas of varying shapes and configurations. Examples of these prior art cleaning devices, some of which have other additional functions, are presented in Batchelder U.S. Pat. No. 2,207,651 showing a spatula with a curved tip, Schacht U.S. Pat. No. 2,591,301 directed to a spatula having projections formed along its longitudinal edges, Bell U.S. Pat. No. 2,901,762 describing a spatula with a slightly curved shape and a complex cross-sectional configuration for the blade, Tupper U.S. Pat. No. 2,900,656 describing a spatula having a rather complex peripheral contour, and Tupper U.S. Pat. No. 2,828,502 comprising a spatula with a slightly curved blade and having a series of prongs on the end of the spatula shaft opposite the blade and intended for corner cleaning.

All of these prior art devices, however, leave some remaining difficulties, especially in cleaning out the contents of catsup bottles and other containers of thick, viscous material. This is particularly true with respect to bottles having flat interior wall surfaces joined by curved corner surfaces. Moreover, they do not usually provide an effective means for unblocking the neck of a catsup bottle.

SUMMARY OF THE INVENTION

It is a principle object of the present invention, therefore, to provide a new and improved bottle cleaning device, particularly adapted to cleanout of a catsup bottle or other like small container for thick, viscous material, that is more effective and efficient in operation than previously known devices of this general kind.

A specific object of the invention is to provide a new and improved bottle cleaning device, effective for use with catsup bottles and like containers, that is simple and inexpensive to manufacture, highly durable, and that provides improved performance in relation to previously known devices.

Accordingly, the invention relates to a bottle cleaning device, formed of durable, flexible, resilient molded resin material, comprising an elongated shaft and a thin, relatively flat primary scraper blade mounted on one end of the shaft with the blade extending transversely of the end of the shaft at an acute angle to the longitudinal axis of the shaft. The scraper blade has an external peripheral configuration affording an elongated essentially linear edge effective for scraping flat interior side surfaces in a bottle, and further has a curved edge effective for scraping curved interior side surfaces and corners in a bottle. The juncture between the blade and the shaft is located centrally of the blade.

BRIEF DESCRIPTION OF THE DRAWINGS

FIG. 1 is an elevation view of a bottle cleaning device constructed in accordance with a preferred embodiment of the present invention;

FIG. 2 is a detailed view taken approximately as indicated by line 2—2 in FIG. 1;

FIG. 3 is a detailed view taken approximately as indicated by line 3—3 in FIG. 1; and FIG. 4 is a detail section view taken approximately as indicated by line 4—4 in FIG. 1.

DESCRIPTION OF THE PREFERRED EMBODIMENT

FIGS. 1-4 illustrate a bottle cleaning device 10, particularly adapted for use in cleanout of catsup bottles but also usable for cleaning out other small containers of relatively thick and viscous material, such as jelly jars and the like, comprising a preferred embodiment of the present invention. The bottle cleaning device 10 includes an elongated shaft 11. Preferably, the overall length L of shaft 11 is of the order of twelve inches.

A thin, relatively flat primary scraper blade 12 is affixed to one end 14 of shaft 11. In normal use of device 10, end 14 is the lower end of shaft 11, as shown in the drawings. In other instances, however, as described below, end 14 may be the upper end of shaft 11 when device 10 is in use. The primary scraper blade 12 extends transversely of end 14 of shaft 11 and is oriented at an acute angle A relative to the longitudinal axis of the shaft as shown in FIG. 1. Preferably, angle A is approximately 40°.

The external peripheral configuration of the primary scraper blade 12 is best shown in FIG. 2. As seen therein, blade 12 is of generally triangular configuration, providing an elongated linear edge 15 and two shorter edges 16. The apex formed by the two short edges 16 is rounded to form a curved edge 17. In the preferred construction for device 10, the length X for the elongated linear edge 15 of blade 12 is about two inches, whereas the overall width W for the primary scraper blade is about three-quarters of an inch. As clearly seen in FIG. 2, the juncture between blade 12 and shaft 11 is located centrally of the surface area of the blade, so that the blade projects outwardly of all sides of the shaft. In FIG. 3 it can be seen that in the preferred construction blade 12 is tilted at another small angle B relative to the axis of shaft 11. Preferably, angle B is of the order of 25°.

A secondary blade 21, again of thin, flat configuration, is mounted on and extends transversely to the end 19 of shaft 11 opposite primary blade 12. As will be apparent from a comparison of FIGS. 2 and 4, the secondary scraper blade 21 is substantially smaller than the primary blade 12. Preferably, blade 21 has a maximum dimension D of about 11/16 inch. Blade 21, as shown, is of generally circular peripheral configuration, with one edge 22 affording a linear segment on the secondary blade.

The individual elements of bottle cleaning device 10 can be formed as separate members and subsequently joined together to form the complete device. Preferably, however, the entire device is formed as a single, molded, unitary member. The resin from which device 10 is molded should be a durable plastic material that is relatively flexible and resilient; nylon or moderately dense polyethylene can be used.

The primary use of bottle cleaning device 10 in the cleanout of material from the bottom portion of a catsup bottle or like container involves the primary blade 12. Because blade 12 is thin, flexible, and resilient, it can be readily inserted into a bottle, even through a narrow neck, with the blade 12 folding back against shaft 11 for convenient insertion into the bottle.

Once inserted into the bottle, the resilient blade 12 opens up. By inserting device 10 completely into the bottle, until the lower corner 18 of blade 12 engages the corner between the side wall and bottom of the bottle, with slight pressure on the shaft 11 the edge 15 of the blade can be made to assume a concave configuration. Rotation of device 10 is then effective to clean out the bottom corner and lower side portions of the bottle, all in one motion.

The linear edge 15 of blade 12 can also be employed to free the contents of the bottle from engagement with any flat side walls in the bottle. The curved edge 17 is effective for cleaning away the bottle contents from any interior curved side surfaces within the bottle, including curved corner portions formed at the intersections of flat surfaces. For small flat interior surfaces, the two side edges 16 of blade 12 are also effective cleaning tools. Any relatively tight corners, including corners at the juncture of side walls with the bottom of the bottle, can be cleared by using the tips 18 and 18' of blade 12 if the edges 15–17 do not afford adequate access.

For a clogged bottle neck, the orientation of device 10 is reversed, vertically, and the secondary blade 21 is used. Thus, blade 21 can be effectively employed to clear a clogged neck in a catsup bottle or the like; the arcuate edge works best in a round-neck bottle and the linear edge segment is used in a neck having flat interior surfaces.

Blade 21 can also be used to regulate the flow from a catsup bottle. By inserting it into the bottle neck and using an in and out motion, blade 21 acts as a collector, and edge 22 allows the contents to be discharged from the bottle at the desired rate. This is considerably easier than the conventional method of hammering on the bottom of the bottle, which usually results in erratic and unpredictable flow.

Bottle cleaning device 10 is simple and economical to manufacture, preferably as a unitary one-piece molded member. Shaft 11 is reasonably flexible, making it easy to probe all parts of the bottle interior with the primary blade 12. Varying bottle configurations present little difficulty, particularly a view of the multi-purpose configuration of blade 12. The secondary blade 21 adds to the versatility of device 10, enabling rapid and convenient clearing of a clogged bottle neck. The device is durable and is easily cleaned.

I claim:

1. A bottle cleaning device, formed of durable, flexible, resilient molded resin material, comprising:

an elongated shaft;

and a thin, relatively flat primary scraper blade mounted on one end of the shaft, the blade extending transversely of the end of the shaft at an acute angle to the longitudinal axis of the shaft, the scraper blade having an external peripheral configuration affording an elongated essentially linear edge effective for scraping flat interior side surfaces in a bottle, and further having a curved edge effective for scraping curved interior side surfaces and corners in a bottle, the juncture between the blade and the shaft being located centrally of the blade.

2. A bottle cleaning device according to claim 1 and further comprising:

a secondary blade of thin, flat configuration, substantially smaller than the primary blade, mounted on and extending transversely of the other end of the shaft, the secondary blade being of generally circular peripheral configuration, effective for scraping the interior side surfaces in the neck of a bottle.

3. A bottle cleaning device according to claim 2 in which the edge of the secondary blade includes a linear segment for scraping a flat interior surface in a bottle neck.

4. A bottle cleaning device according to claim 1, or claim 2, or claim 3, in which the angle of inclination between the shaft and the main scraper blade is about 40°.

5. A bottle cleaning device according to claim 4 in which the primary blade is generally in the configuration of a triangle, the linear edge comprising a long side of the triangle, and the apex formed by two short sides of the triangle being rounded to form the curved edge.

6. A bottle cleaning device according to claim 5, in which all elements of the device are formed as a single, unitary molded member.

7. A bottle cleaning device according to claim 6 in which the curved edge portion of the primary blade extends upwardly from the central portion of that blade at an angle of about 25°.

8. A bottle cleaning device according to claim 1 in which the primary blade is generally in the configuration of a triangle, the linear edge comprising a long side of the triangle, and the apex formed by two short sides of the triangle being rounded to form the curved edge.

9. A bottle cleaning device according to claim 8 in which the curved edge portion of the primary blade extends upwardly from the central portion of that blade at an angle of about 25°.

10. A bottle cleaning device according to claim 8 or claim 9 in which all elements of the device are formed as a single, unitary molded member.

* * * * *